US008126373B2

(12) United States Patent
Utsunomiya et al.

(10) Patent No.: US 8,126,373 B2
(45) Date of Patent: Feb. 28, 2012

(54) TONER SUPPLY DEVICE AND IMAGE FORMING APPARATUS THAT PREVENTS TONER FROM BEING SCATTERED FROM THE DEVICE

(75) Inventors: Kohichi Utsunomiya, Atsugi (JP); Koichi Kato, Yokohama (JP); Junichi Terai, Isehara (JP); Klyonori Tsuda, Yokohama (JP); Emi Kita, Tokyo (JP); Satoru Yoshida, Zama (JP); Yuki Oshikawa, Yamato (JP)

(73) Assignee: Ricoh Company Limited, Tokyo (JP)

( * ) Notice: Subject to any disclaimer, the term of this patent is extended or adjusted under 35 U.S.C. 154(b) by 443 days.

(21) Appl. No.: 12/238,815

(22) Filed: Sep. 26, 2008

(65) Prior Publication Data

US 2009/0087214 A1 Apr. 2, 2009

(30) Foreign Application Priority Data

Sep. 28, 2007 (JP) ..... 2007-254875
Sep. 28, 2007 (JP) ..... 2007-254882

(51) Int. Cl.
*G03G 15/08* (2006.01)

(52) U.S. Cl. ..... 399/258

(58) Field of Classification Search ..... 399/258, 399/260, 262
See application file for complete search history.

(56) References Cited

U.S. PATENT DOCUMENTS 5,734,953 A * 3/1998 Tatsumi ..... 399/262
(Continued)

FOREIGN PATENT DOCUMENTS

JP 6-95505 4/1994
(Continued)

*Primary Examiner* — Quana M Grainger
(74) *Attorney, Agent, or Firm* — Oblon, Spivak, McClelland, Maier & Neustadt, L.L.P.

(57) ABSTRACT

A toner supply device includes a toner container, a transport-path forming member, an opening, a shutter member, and a first seal member. The opening is provided at a side wall of the transport-path forming member. The shutter member is movable between a closed position to close the transport path by being inserted in the opening and an open position. The first seal member fills a gap between an inner wall of the opening and the shutter member in a toner transport direction in which the toner is transported through the transport path. When the shutter member is inserted in the opening, the shutter member is elastically deformable in a deformation direction perpendicular to both the toner transport direction and a moving direction of the shutter member, and when the shutter member is not inserted in the opening, the shutter member is wider than the opening in the deformation direction.

19 Claims, 14 Drawing Sheets

U.S. PATENT DOCUMENTS

| | | | | |
|---|---|---|---|---|
| 5,774,773 | A * | 6/1998 | Otsuka et al. | 399/262 |
| 7,792,468 | B2 * | 9/2010 | Ichikawa et al. | 399/262 |
| 2002/0064401 | A1 * | 5/2002 | Ashikari | 399/258 |
| 2006/0104671 | A1 * | 5/2006 | Murakami et al. | 399/258 |
| 2006/0110319 | A1 * | 5/2006 | Seok et al. | 423/610 |
| 2007/0077098 | A1 | 4/2007 | Katsuyama et al. | |
| 2007/0081835 | A1 | 4/2007 | Tsuda et al. | |
| 2007/0116494 | A1 | 5/2007 | Uno et al. | |
| 2007/0122204 | A1 | 5/2007 | Kita | |
| 2007/0140747 | A1 | 6/2007 | Kita et al. | |
| 2007/0160392 | A1 | 7/2007 | Tsuda et al. | |
| 2007/0166074 | A1 | 7/2007 | Hosokawa et al. | |
| 2007/0172252 | A1 * | 7/2007 | Koyama et al. | 399/106 |
| 2007/0177905 | A1 | 8/2007 | Hosokawa et al. | |
| 2007/0264052 | A1 | 11/2007 | Yoshida et al. | |
| 2007/0264054 | A1 | 11/2007 | Tsuda et al. | |
| 2008/0003021 | A1 | 1/2008 | Hosokawa et al. | |
| 2008/0025761 | A1 | 1/2008 | Yoshida | |
| 2008/0038021 | A1 | 2/2008 | Tsuda et al. | |
| 2008/0063433 | A1 | 3/2008 | Miyamoto et al. | |
| 2008/0085138 | A1 | 4/2008 | Yoshida | |
| 2008/0124136 | A1 | 5/2008 | Oshikawa | |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |
| 2008/0187332 | A1 | 8/2008 | Tsuda et al. | |

FOREIGN PATENT DOCUMENTS

| | | | |
|---|---|---|---|
| JP | 08292635 | A * | 11/1996 |
| JP | 3054323 | | 4/2000 |
| JP | 2002-341637 | | 11/2002 |
| JP | 2004264429 | A * | 9/2004 |

* cited by examiner

TONER SUPPLY DEVICE AND IMAGE FORMING APPARATUS THAT PREVENTS TONER FROM BEING SCATTERED FROM THE DEVICE

CROSS-REFERENCE TO RELATED APPLICATIONS

The present patent application claims priority pursuant to 35 U.S.C. §119 from Japanese Patent Application Nos. 2007-254875, filed on Sep. 28, 2007, and 2007-254882, filed on Sep. 28, 2007 in the Japan Patent Office, the entire contents of each of which are hereby incorporated herein by reference.

BACKGROUND OF THE INVENTION

1. Field of the Invention

The present invention relates to a toner supply device useable in an image forming apparatus such as a copier, a facsimile machine, and a printer, and an image forming apparatus including the toner supply device.

2. Description of the Background

Image forming apparatuses are used as copiers, printers, facsimile machines, and multi-functional devices combining several of the foregoing capabilities. A conventional image forming apparatus includes a detachably mountable toner supply device to supply toner to a developing device. When the toner supply device is mounted in or detached from the image forming apparatus with an opening provided in the toner supply device to discharge toner uncovered, a portion of the toner may be scattered from the opening, resulting in failures such as contamination of the image forming apparatus and/or its surrounding area. To prevent such scattering of toner, a shutter for alternately uncovering and covering the opening may be provided in the image forming apparatus. In such configuration, for example, the opening is uncovered by the shutter when the toner supply device is mounted in the image forming apparatus but covered with the shutter when the toner supply device is detached from the image forming apparatus.

A conventional toner supply device includes a shutter on a bottom wall of the toner supply device to discharge toner, movable between a closed position to close the toner discharge port and an open position to open the toner discharge port. The shutter is moved along an outer face of the bottom wall of the toner supply device by a guide member provided on the outer face of the bottom wall behind the toner discharge port with respect to the shutter. A seal member contactable against the outer face of the bottom wall is attached to the shutter so as to seal the toner discharge port when the shutter is at the closed position to close the toner discharge port. Such contact between the seal member and the outer face of the bottom wall can prevent a gap from forming between the shutter and the outer face of the bottom wall of the toner supply device, thereby providing excellent sealability.

FIG. 19 is a schematic view illustrating a toner transfer portion from a toner supply device 100 to a developing device 200 in an image forming apparatus. In FIG. 19, an opening 109 into which a shutter 125 is inserted is formed on a side wall of a case 101 that forms a part of a toner flow path t1. The shutter 125 is inserted as illustrated in FIG. 20 to open and close the toner flow path t1.

In this regard, the shutter 125 needs to reliably close the toner flow path t2 and fit snugly in the opening 109.

FIGS. 21 and 22 illustrate sectional views cut along a line XXI-XXI of FIG. 20. As illustrated in FIG. 21, if there are gaps 401 and 402 between the shutter 125 and the opening 109, toner may be inadvertently scattered from such gaps 401 and 402. Such toner scattering may occur, in particular, during operation of the image forming apparatus. For example, as illustrated in FIG. 20, during operation of the image forming apparatus, toner whose fluidity is increased by an agitator flows down from an upper portion of the toner flow path t1. As a result, a portion of the toner may be scattered through the gaps 401 and 402 to the outside of the case 101. Further, at a lower portion of the toner flow path t1 close to the developing device 200, a screw 204 for transporting the toner in a direction indicated by an arrow t2 in FIG. 20 flips the toner upward in directions indicated by arrows t3. As a result, a portion of the toner may be scattered from the gaps 401 and 402. When a toner having a relatively small particle diameter is used, such toner may more readily pass through the gaps to the outside, thereby resulting in more notable toner scattering. Alternatively, using a relatively high-speed developing device may cause the screw to flip up the toner intensively, similarly resulting in more notable toner scattering.

To prevent toner from being scattered from the opening 109, such gaps need be filled by closely contacting the shutter 125 against side surfaces 403 and 404 as illustrated in FIG. 22.

However, the shutter 125 and the side surfaces 403 and 404 may have dimensional tolerances, resulting in a discrepancy in size, and thus a discrepancy in fit, between the shutter 125 and the opening 109. In such a case, if the shutter 125 is too large compared to the opening 109, the shutter 125 may be prevented from moving into the opening 109, or moved only with great difficulty, thereby degrading the slidability of the opening 109. By contrast, if the shutter 125 is too small compared to the opening 109, gaps may appear between the shutter 125 and the side surfaces 403 and 404, resulting in toner leakage from the gaps.

Hence, in the above-described conventional toner supply device, the toner discharge port is provided to the outer face of the bottom wall of the toner supply device and the seal member is attached to the shutter so as to contact the outer face of the bottom wall of the toner supply device to prevent gaps from appearing between the shutter and the outer face of the bottom wall of the toner supply device.

However, in the conventional toner supply device, sufficient consideration is not given to gaps appearing between a guide member and end portions in the width direction of the shutter, which may result in toner leakage from the gaps.

In view of the above-described situation, the present disclosure provides a toner supply device capable of reliably opening and closing a shutter member to prevent toner from being scattered from the device, and an image forming apparatus including the toner supply device.

SUMMARY OF THE INVENTION

At least one exemplary embodiment of the present invention provides a toner supply device capable of reliably opening and closing a shutter member to prevent toner from being scattered from the device, and an image forming apparatus including the toner supply device.

In one exemplary embodiment of the present invention, a toner supply device includes a toner container, a transport-path forming member, an opening, a shutter member, and a first seal member. The toner container stores toner. The transport-path forming member forms a transport path to transport the toner stored in the toner container to the outside of the toner container. The opening is provided at a side wall of the transport-path forming member. The shutter member is movable between a closed position to close the transport path by being inserted in the opening and an open position to open the transport path. The first seal member fills a gap between an inner wall of the opening and the shutter member in a toner transport direction in which the toner is transported through the transport path. When the shutter member is inserted in the opening, the shutter member is elastically deformable in a deformation direction perpendicular to both the toner transport direction and a moving direction of the shutter member, and when the shutter member is not inserted in the opening, the shutter member is wider than the opening in the deformation direction.

In another exemplary embodiment of the present invention, an image forming apparatus includes a latent image carrier, a developing unit, and a toner supply device. The latent image carrier carries a latent image. The developing unit develops the latent image carried on the latent image carrier with toner into a toner image. The toner supply device supplies the toner to the developing unit. The toner supply device includes a toner container, a transport-path forming member, an opening, a shutter member, and a first seal member. The toner container stores the toner. The transport-path forming member forms a transport path to transport the toner stored in the toner container to the developing unit. The opening is provided at a side wall of the transport-path forming member. The shutter member is movable between a first position to close the transport path by being inserted in the opening and a second position to open the transport path. The first seal member fills a gap between an inner wall of the opening and the shutter member in a toner transport direction in which the toner is transported through the transport path. When the shutter member is inserted in the opening, the shutter member is elastically deformable in a deformation direction perpendicular to both the toner transport direction and a moving direction of the shutter member, and when the shutter member is not inserted in the opening, the shutter member is wider than the opening in the deformation direction.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
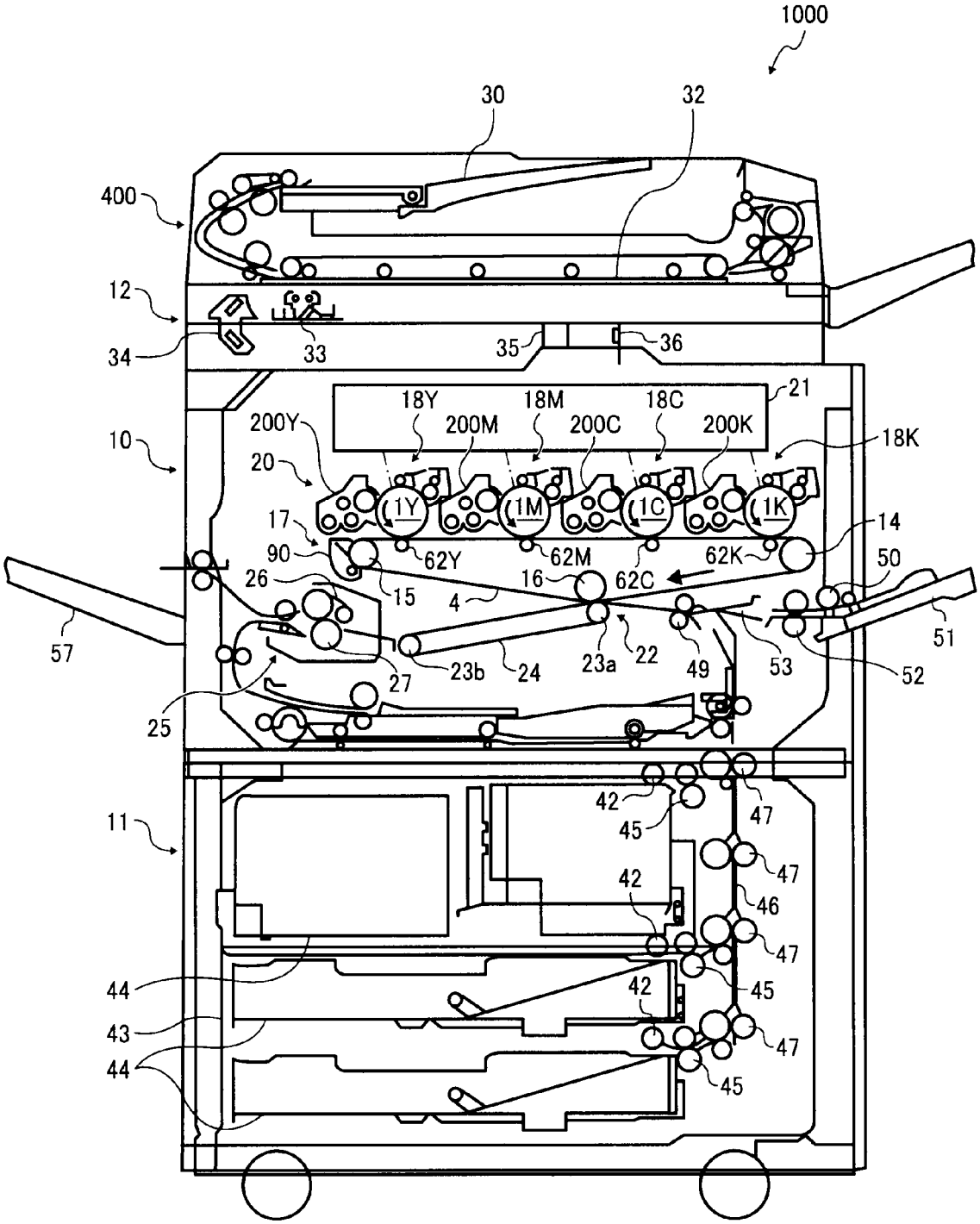
FIG. 1 is a schematic view illustrating a configuration of an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Below, taking as an example a tandem-type color laser copier (hereinafter a "copier") in which a plurality of photoconductors are arranged side by side, an image forming apparatus 1000 according to an exemplary embodiment of the present invention is described.

FIG. 1 is a schematic view illustrating a configuration of the image forming apparatus 1000 according to this exemplary embodiment. As illustrated in FIG. 1, the image forming apparatus 1000 includes, for example, a printer section 10, a sheet feed section 11 on which the printer section 10 is mounted, and a scanner 12 disposed on the printer section 10. The image forming apparatus 1000 also includes an automatic document feeder 400 disposed on the scanner 12.

The printer section 10 has an image forming unit 20 including, for example, four process cartridges 18Y, 18M, 18C, and 18K to form images of yellow (Y), magenta (M), cyan (C), and black (K), respectively. Hereinafter, the letters Y, M, C, and K added to numeral codes indicate components or members for yellow, magenta, cyan, and black, respectively. In addition to the process cartridges 18Y, 18M, 18C, and 18K, the image forming apparatus 1000 further includes an optical write unit 21, an intermediate transfer unit 17, a secondary transfer device 22, a pair of registration rollers 49, and a fixing device 25 using, for example, a belt fixing system.

The optical write unit 21 includes, for example, a light source, a polygon mirror, an f-θ lens, and a reflection mirror, and emits a laser beam onto the surface of each photoconductor based on scanned image data.

Each of the process cartridges 18Y, 18M, 18C, and 18K includes a drum-shaped photoconductor 1, a charger, a developing device 200, a drum cleaner, and a discharger.

Below, taking the yellow process cartridge 18Y as an example, the process cartridges 18Y, 18M, 18C, and 18K are described further in detail.

The charger serving as a charging unit uniformly charges the surface of the photoconductor 1Y. The charged surface of the photoconductor 1Y is irradiated with a laser beam modulated and deflected by the optical write unit 21 according to the scanned image data. As a result, the electric potential of a portion irradiated or exposed with the laser beam decreases, so that an electrostatic latent image for yellow is formed on the surface of the photoconductor 1Y. The electrostatic latent image for yellow is developed with the developing device 200Y into a yellow toner image.

The yellow toner image formed on the photoconductor 1Y is primarily transferred onto an intermediate transfer belt 4. After the primary transfer process, the drum cleaner removes residual toner remaining on the surface of the photoconductor 1Y.

After the cleaning with the drum cleaner, the charge remover removes the charge from the photoconductor 1Y. Then, the charger uniformly charges the surface of the photoconductor 1Y again, and thus the photoconductor 1Y is initialized. Likewise, a series of processes similar to those described above is performed at each of the other process cartridges 18M, 18C, and 18K.

Next, the intermediate transfer unit 17 is described.

The intermediate transfer unit 17 includes the intermediate transfer belt 4, a belt cleaner 90, a tension roller 14, a driving roller 15, a secondary transfer back-up roller 16, and primary transfer bias rollers 62Y, 62M, 62C, and 62K, for example.

The intermediate transfer belt 4 is stretched between a plurality of rollers including the tension roller 14. As the driving roller 15 is rotated by a belt driving motor, the intermediate transfer belt 4 is endlessly moved in a clockwise direction in FIG. 1.

The four primary-transfer bias rollers 62Y, 62M, 62C, and 62K are disposed so as to contact an inner circumferential surface of the intermediate transfer belt 4 and receive primary-transfer biases applied from a power supply. The primary-transfer bias rollers 62Y, 62M, 62C, and 62K press the intermediate transfer belt 4 from the inner circumferential surface toward the photoconductors 1Y, 1M, 1C, and 1K, respectively, to form primary-transfer nips. At each primary-transfer nip, the primary-transfer bias forms primary-transfer electric fields between each photoconductor and the corresponding primary-transfer bias roller.

The above-described yellow toner image formed on the photoconductor 1Y is primarily transferred onto the intermediate transfer belt 4 by the primary-transfer electric field and nip pressure at the primary transfer nip. Magenta, cyan, and black toner images on the photoconductors 1M, 1C, and 1K are primarily transferred onto the yellow toner image so as to be sequentially superimposed one on another. Thus, a four-color composite toner image (hereinafter a "four-color toner image"), including multiple toner images, is formed on the intermediate transfer belt 4.

The four-color toner image superimposingly transferred on the intermediate transfer belt 4 is secondarily transferred onto a transfer sheet, serving as a recording material, at a secondary transfer nip. After passing through the secondary transfer nip, the belt cleaner 90 sandwiching the intermediate transfer belt 4 between it and the driving roller 15 removes residual toner remaining on the surface of the intermediate transfer belt 4.

Next, the secondary transfer device 22 is described.

In FIG. 1, the secondary transfer device 22 is disposed below the intermediate transfer unit 17. In the secondary transfer device 22, a sheet conveyance belt 24 is extended between two tension rollers 23*a* and 23*b*. As at least one roller of the tension rollers 23*a* and 23*b* is driven, the sheet conveyance belt 24 is endlessly moved in a counterclockwise direction in FIG. 1. The tension roller 23*a* sandwiches the intermediate transfer belt 4 and the sheet conveyance belt 24 between it and the secondary-transfer back-up roller 16 of the intermediate transfer unit 17. Such sandwiching forms the secondary transfer nip at which the intermediate transfer belt 4 of the intermediate transfer unit 17 contacts the sheet conveyance belt 24 of the secondary transfer device 22. A secondary transfer bias having a polarity opposite to the polarity of the toner is supplied to the tension roller 23*a* from a power supply. Such supply of the secondary transfer bias forms secondary-transfer electric fields to electrostatically move the four-color toner image on the intermediate transfer belt 4 toward the tension roller 23*a*. The pair of registration rollers 49 feeds the transfer sheet so as to synchronize with the four-color toner image on the intermediate transfer belt 4. The four-color toner image is secondarily transferred onto the transfer sheet by the secondary-transfer electrical field and nip pressure at the secondary transfer nip.

Alternatively, instead of the above-described secondary transfer system to supply the secondary transfer bias to the tension roller 23*a*, a charger may be provided to charge the transfer sheet in a non-contact manner, for example.

The sheet feed device 11 disposed at a lower portion of the image forming apparatus 1000 includes a plurality of vertically stacked sheet feed cassettes 44. Each sheet feed cassette 44 is capable of storing a plurality of transfer sheets stacked in a bundled state and pressing a sheet feed roller 42 against a topmost sheet of the bundled transfer sheets. As the sheet feed roller 42 is rotated, the topmost transfer sheet is fed toward a sheet feed path 46.

The sheet feed path 46 into which the transfer sheet is fed from the sheet feed cassette 44 includes a plurality of pairs of conveyance rollers 47 and a pair of registration rollers 49 that is provided near an end portion of the sheet feed path 46. The transfer sheet conveyed to the pair of registration rollers 49 is sandwiched between the pair of registration rollers 49. Meanwhile, in the intermediate transfer unit 17, the four-color toner image formed on the intermediate transfer belt 4 is conveyed into the secondary transfer nip as the intermediate transfer belt 4 is endlessly moved. The pair of registration rollers 49 feeds the transfer sheet sandwiched therebetween at such a timing that the transfer sheet closely contacts the four-color toner image at the secondary transfer nip. By closely contacting the four-color toner image with the transfer sheet at the secondary transfer nip, the four-color toner image is secondarily transferred onto the transfer sheet to form a full-color image on the transfer sheet of white color, for example. As the sheet conveyance belt 24 is endlessly moved, the transfer sheet having the full-color image passes through the secondary transfer nip and is fed from the sheet conveyance belt 24 to the fixing device 25.

The fixing device 25 includes a belt unit and a pressure roller 27. The belt unit includes a fixing belt 26 and two, first and second, rollers. The fixing belt 26 is extended between the first and second rollers so as to be endlessly movable. The pressure roller 27 is pressed against the first roller. The fixing belt 26 and the pressure roller 27 contact each other to form a fixing nip at which the transfer sheet received from the sheet conveyance belt 24 is sandwiched. The first roller pressed by the pressure roller 27 includes a heat source for generating heat while pressing against the fixing belt 26. The fixing belt 26 pressed by the first roller heats the transfer sheet sandwiched at the fixing nip. Such heat and pressure at the fixing nip fixes the full-color image on the transfer sheet.

After the fixing process in the fixing device 25, the transfer sheet is stacked on a stack portion 57 provided to a left-side plate of an apparatus housing in FIG. 1, or is returned to the secondary transfer nip to form a toner image on another face of the transfer sheet.

When copying a bundle of documents, the bundle of documents may be set on a document table 30 of the automatic document feeder 400. Alternatively, if one side of the documents is bound in a book form, the documents are set on a contact glass 32. Before setting the documents, the automatic document feeder 400 is opened relative to a body of the image forming apparatus to expose the contact glass 32 of the scanner 12 to the outside. After placing the one-side bound documents on the contact glass 32, the automatic document feeder 400 is closed to press the documents against the contact glass 32.

After setting the documents, a copy start button is pressed to start a document reading operation of the scanner 12. Alternatively, if the bundle of documents is set on the automatic document feeder 400, the automatic document feeder 400 automatically feeds the sheet documents one by one to the contact glass 32 before the document reading operation.

In the document reading operation, a first carriage 33 and a second carriage 34 start running, and a light source of the first carriage 33 emits light. The light is reflected on the surface of the document and a mirror of the second carriage 34, passes through a focus lens 35, and enters into a reading sensor 36. The reading sensor 36 creates image data based on the entered light.

In parallel with the document reading operation, components in the process cartridges 18Y, 18M, 18C, and 18K, the intermediate transfer unit 17, the secondary transfer device 22, and the fixing device 25 start driving. The driving of the optical write unit 21 is controlled based on the image data created by the reading sensor 36 so as to form yellow, magenta, cyan, and black toner images on the photoconductors 40Y, 40M, 40C, and 40K, respectively. The toner images are superimposed on the intermediate transfer belt 4 so that a full-color toner image is formed on the intermediate transfer belt 4.

At substantially the same time as the start of the document reading operation, the sheet feed device 11 starts a sheet feed operation. In the sheet feed operation, as one of the sheet feed rollers is selected to rotate, a transfer sheet is fed from a corresponding one of the sheet feed cassettes 44 stacked in a paper bank 43. The transfer sheet fed from the corresponding sheet feed cassette 44 is separated one by one with a corresponding separation roller 45, moved into the sheet-feed path 46, and conveyed toward the secondary transfer nip with the pair(s) of conveyance rollers 47.

Instead of feeding from the sheet feed cassette 44, transfer sheets may be fed from a manual feed tray 51. In such case, as a manual feed roller 50 is selected and rotated to feed the transfer sheets from the manual feed tray 51, a separation roller 52 separates and feeds the transfer sheets one by one to a manual feed path 53 of the printer section 10.

When forming a multiple-color image of more than two color toners, the image forming apparatus 1000 holds the upper extending face of the intermediate transfer belt 4 substantially horizontal so that the upper extending surface contacts the photoconductors 1Y, 1M, 1C, and 1K. Alternatively, when forming a black-and-white image of only black toner, a tilting mechanism tilts the intermediate transfer belt 4 down to the left in FIG. 1 so as to separate the upper extending face from the photoconductors 1Y, 1M, 1C. Only the photoconductor 1K among the four photoconductors is rotated in the counterclockwise direction in FIG. 1 to form a black toner image. At this time, the developing devices 200Y, 200M, and 200C as well as the photoconductors 1Y, 1M, and 1C may be stopped, thereby preventing them from being unnecessarily wasted.

According to this exemplary embodiment, the image forming apparatus 1000 includes a control unit and an operation display unit. The control unit also includes a CPU (central processing unit) to control components in the image forming apparatus 1000. The operation display unit includes a liquid crystal display and various key buttons. An operator performs key input operations through the operation display unit to send commands to the control unit. In such operations, the operator is allowed to select one of, for example, three modes as a simplex print mode for forming an image on only one side of a transfer sheet. The three simplex print modes are, for example, direct ejection mode, reverse ejection mode, and reverse decurling ejection mode.

Figure 2:
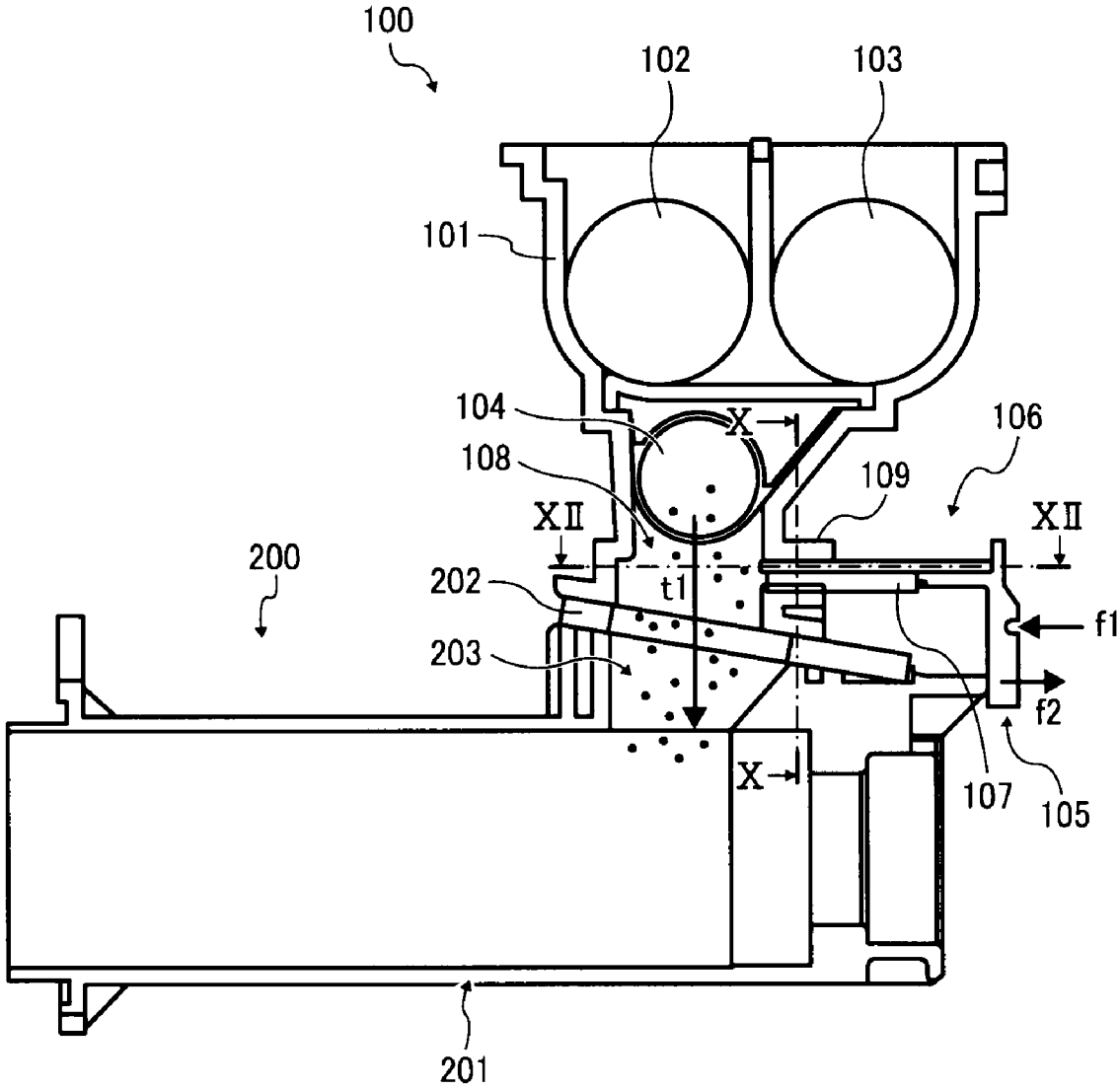
FIG. 2 is a schematic view illustrating a configuration of a toner supply device according to an exemplary embodiment of the present invention.

FIG. 2 is a schematic view illustrating a toner supply device 100 to supply toner to a developing device 200. The toner supply device 100 is the distinctive feature of the image forming apparatus according to this exemplary embodiment.

The toner supply device 100 is mounted in the image forming apparatus to supply toner to the developing device 200. The toner supply device 100 includes a case 101, agitators 102, 103, and 104, and a shutter 105, for example. The toner supply device 100 is detachably mountable in the image forming apparatus. When the toner supply device 100 is mounted in the image forming apparatus, a supply port 108 is communicated with a toner receive port 203 of the developing device 200 to supply toner.

Figure 3:
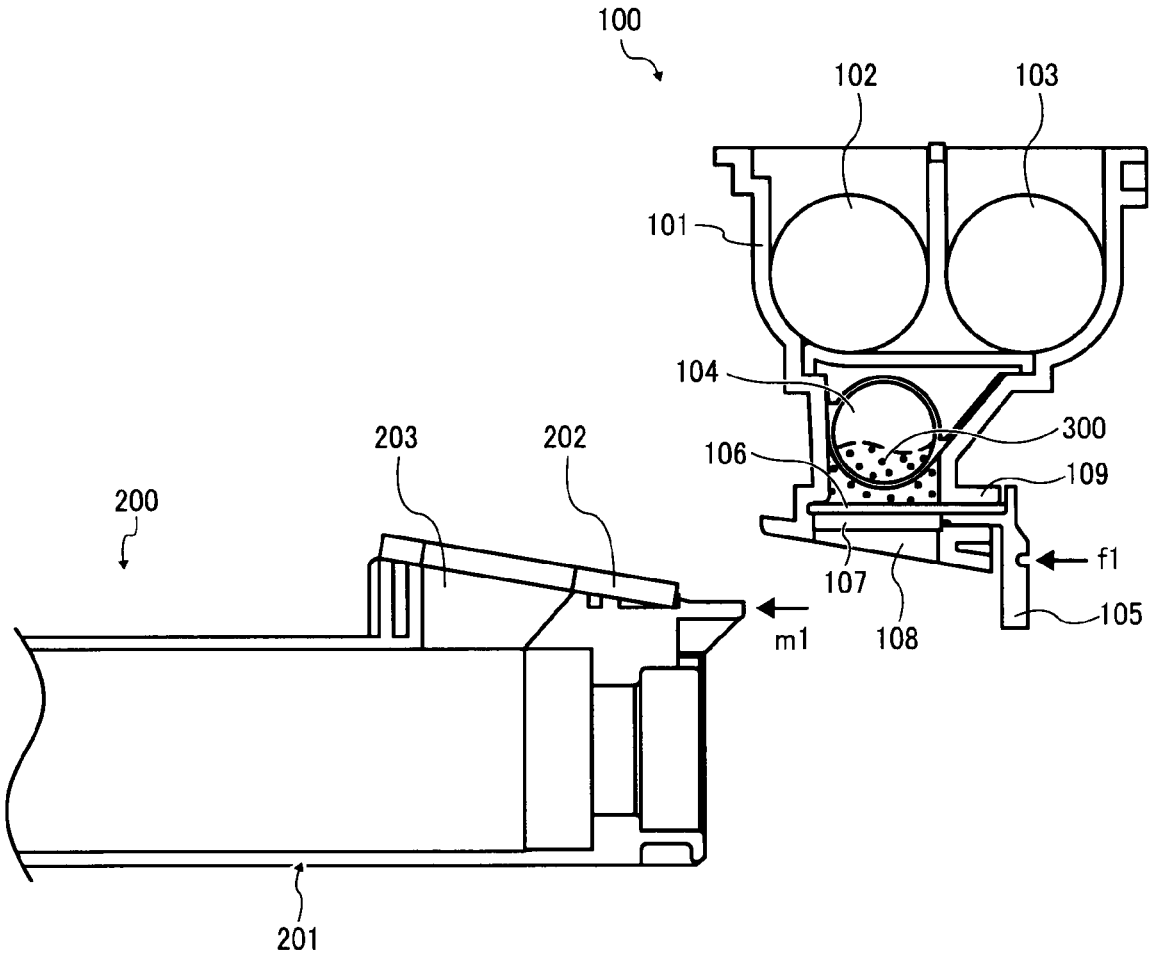
FIG. 3 is a schematic view illustrating a state in which the toner supply device of FIG. 2 is detached from the image forming apparatus.

In FIG. 3, the shutter 105 is biased by a coil spring in a direction f1 to close the shutter 105. When the toner supply device 100 is detached from the image forming apparatus, the supply port 108 is closed with the shutter 105. When the toner supply device 100 is installed to the image forming apparatus, the toner supply device 100 approaches the developing device 200 in a direction indicated by an arrow ml of FIG. 3 and mounted to the developing device 200 in a state illustrated in FIG. 2. At this time, a developing device case 201 pushes open the shutter 105, thereby communicating the supply port 108 with the toner receive port 203.

Figure 4:
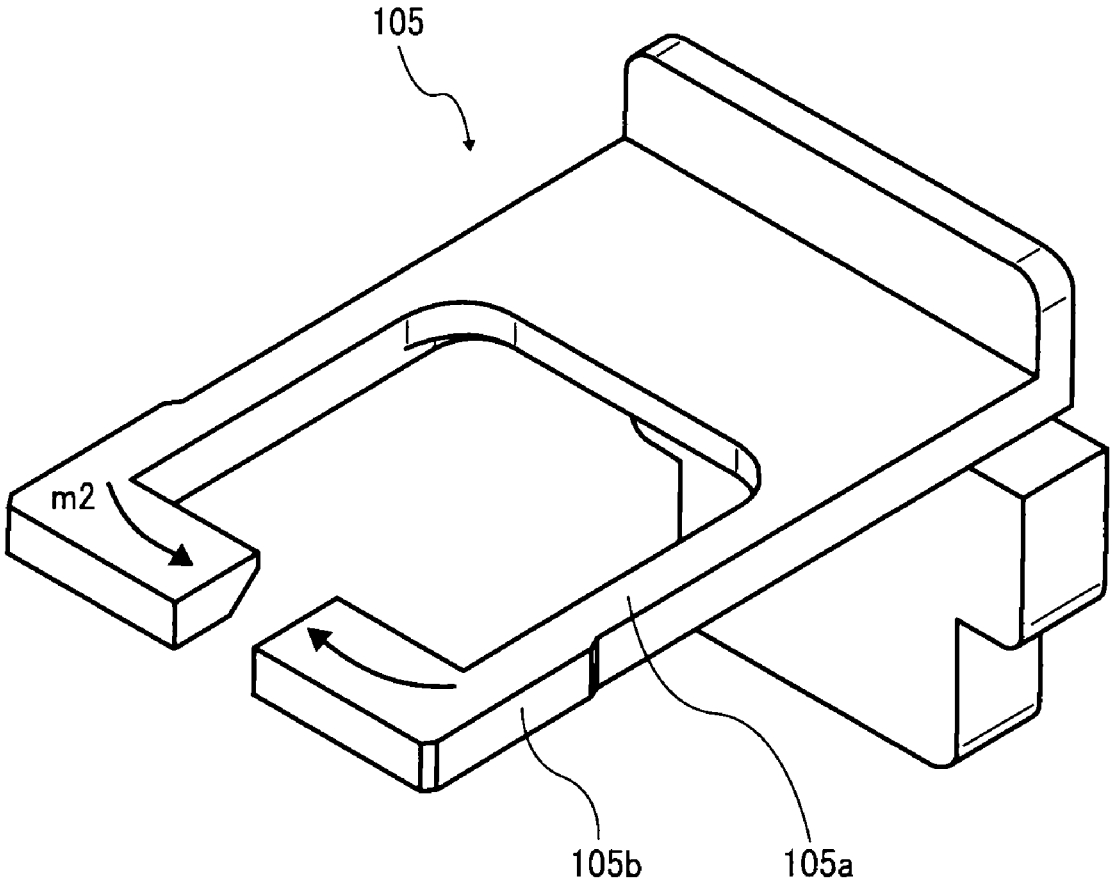
FIG. 4 is a schematic view illustrating a shape of a shutter according to an exemplary embodiment.

FIG. 4 is a perspective view illustrating a shutter 105 according to an exemplary embodiment of the present invention. The shutter 105 includes leaf spring portions 105*a*. Each leaf spring portion 105*a* is deformable in a horizontal direction, thereby allowing a front-end portion of the shutter 105 to be deformed in directions indicated by arrows m2. According to this exemplary embodiment, since the shutter 105 is biased by the coil spring from one side, the shutter 105 needs to have stiffness so as not to be deformed vertically. Hence, the shutter 105 employs the leaf springs to obtain preferable elasticity in the horizontal direction and preferable stiffness in the vertical direction.

Figure 5:
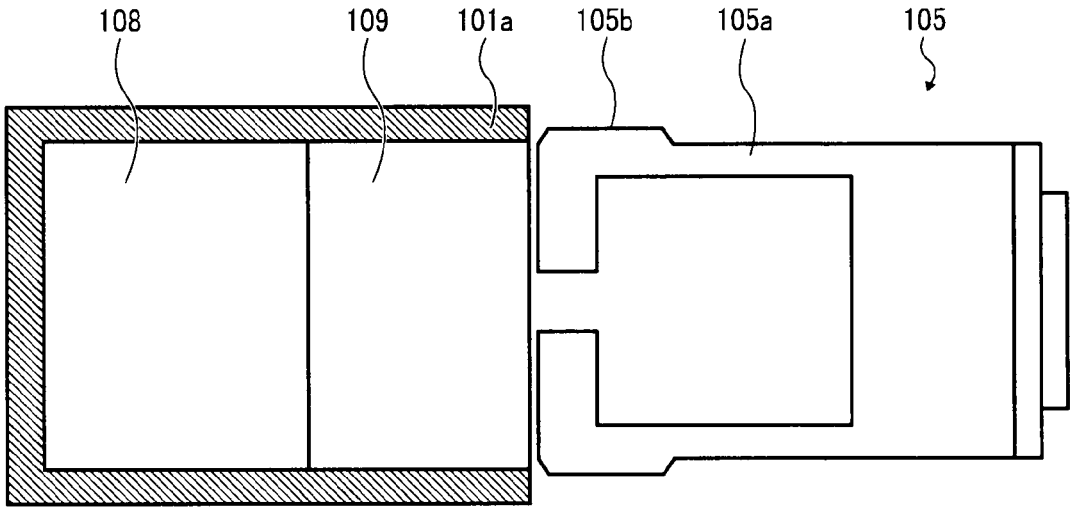
FIG. 5 is a schematic view illustrating a state before the shutter of FIG. 4 is inserted into an opening.
Figure 6:
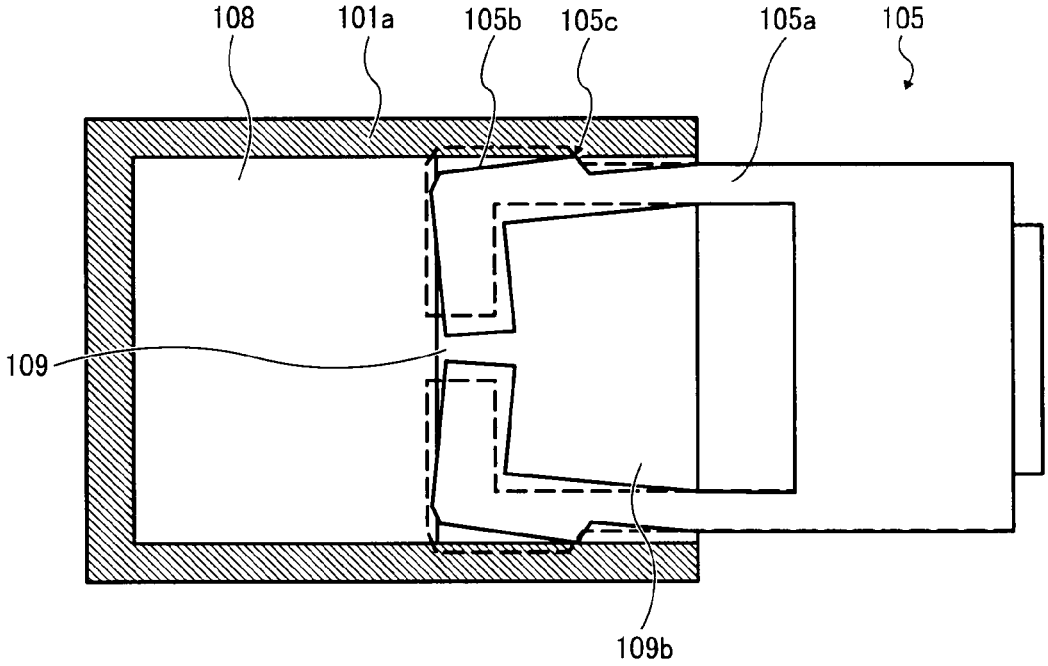
FIG. 6 is a schematic view illustrating a state after the shutter of FIG. 4 is inserted into the opening.

As illustrated in FIG. 5, according to this exemplary embodiment, the shutter 105 is provided with convex portions 105*b*, making the width of the shutter 105 greater than the width of an opening 109 into which the shutter 105 is inserted. As illustrated in FIG. 6, deformation of the leaf spring portions 105*a* reduces the width of the shutter 105, thereby allowing the shutter 105 to be inserted to the opening 109. The convex portions 105*b* limit an area contacting a wall face 101*a* of the opening 109 to only a rear-end portion 105*c* of each convex portion 105*b*. Such configuration can reduce friction between the wall face 101*a* and the shutter 105, thereby allowing the shutter 105 to slide against the wall face 101*a* with reduced load.

The width of the shutter 105 and the size of the opening 109 are determined based on, for example, sealability, slidability, and the amount of deformation suitable for the shutter 105. If the width of the shutter 105 is too large, the restoration force of the leaf spring portions 105*a* would increase, thereby degrading the slidability of the shutter 105. Further, as described below with reference to FIG. 11, such configuration may increase the amount of deformation of a seal member, thereby resulting in toner scattering.

By contrast, if the width of the shutter 105 is too small, the side faces of the shutter 105 would not be able to sufficiently contact the wall face 101*a* of the opening 109, thereby preventing a desired degree of sealability from being obtained.

Therefore, according to this exemplary embodiment, the maximum widths of the shutter 105 and the opening 109 are set to, for example, approximately 15.4 mm and approximately 15 mm, respectively.

Figure 7:
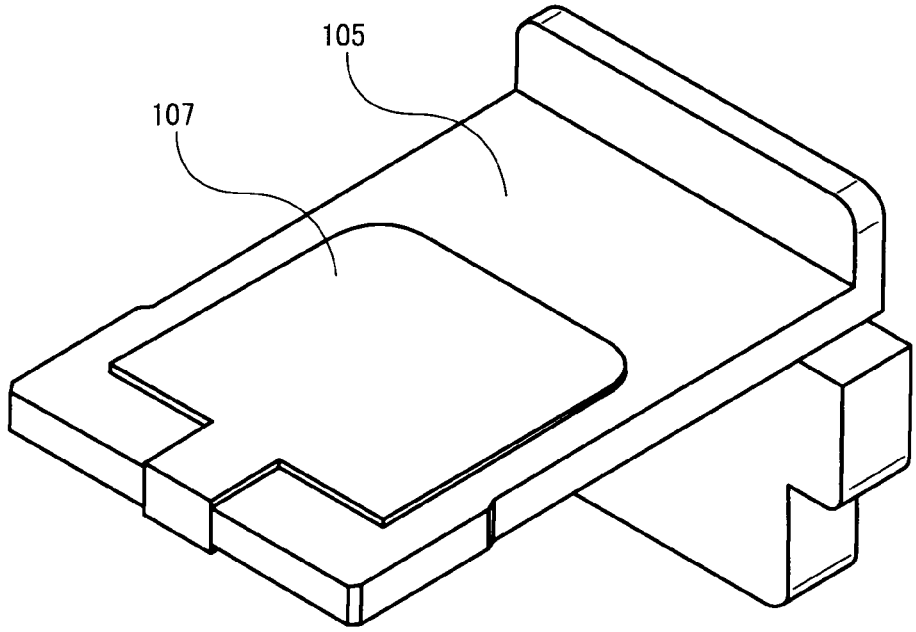
FIG. 7 is a schematic view illustrating the shutter of FIG. 4, fitted with a seal member.
Figure 8:
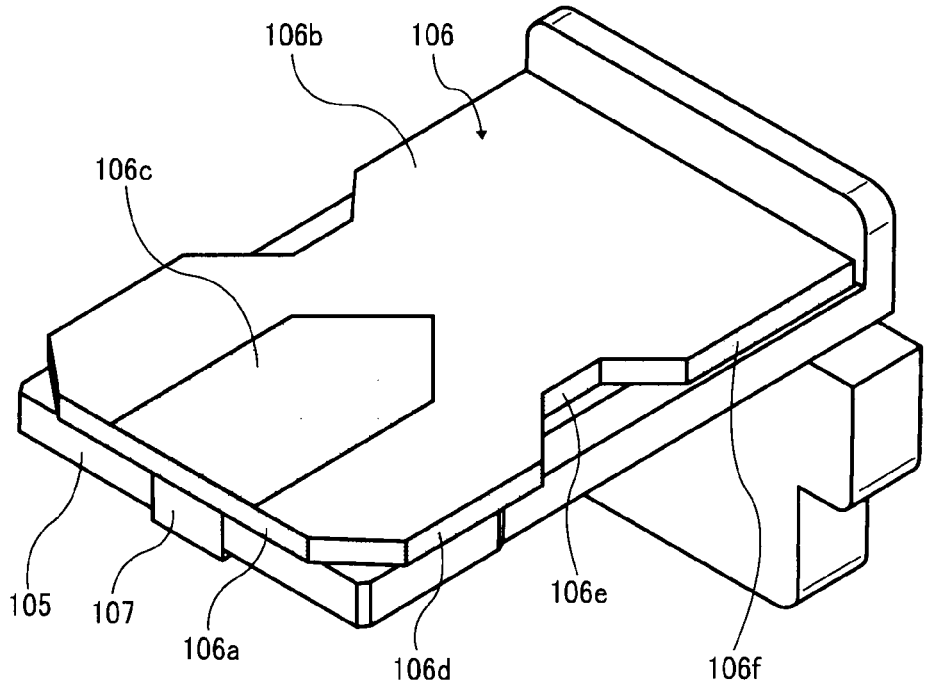
FIG. 8 is a schematic view illustrating the shutter of FIG. 7, to which a seal is attached.
Figure 9:
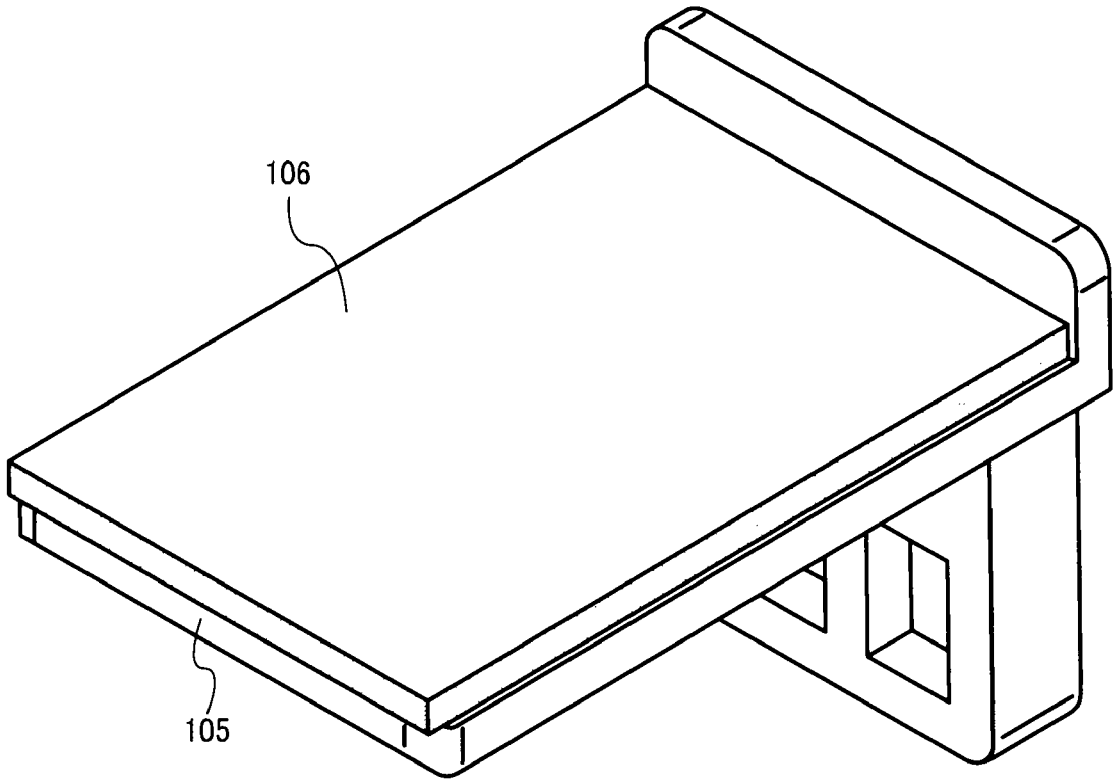
FIG. 9 is a schematic view illustrating another shape of the seal.

Further, according to this exemplary embodiment, the shutter 105 is used along with two seal members. One is a seal member 107 fitted into an opening at a middle portion of the shutter 105 as illustrated in FIG. 7. The other is a seal 106 covering the upper face of the shutter 105 as illustrated in FIG. 8. It is to be noted that the shape of the seal 106 is not limited to the shape illustrated in FIG. 8, but may be a shape illustrated in FIG. 9, for example.

The seal 106 includes a sponge member 106*a* and a film member 106*b* that covers an upper face of the sponge member 106*a*. A cutout portion 106*c* is formed in the film member 106*b*.

Figure 10:
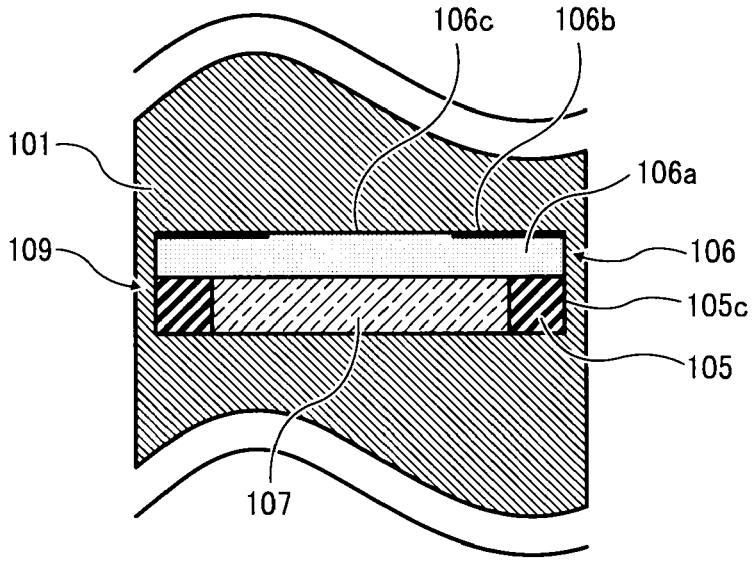
FIG. 10 is a sectional view illustrating the shutter and the opening cut along a line X-X in FIG. 2.
Figure 11:
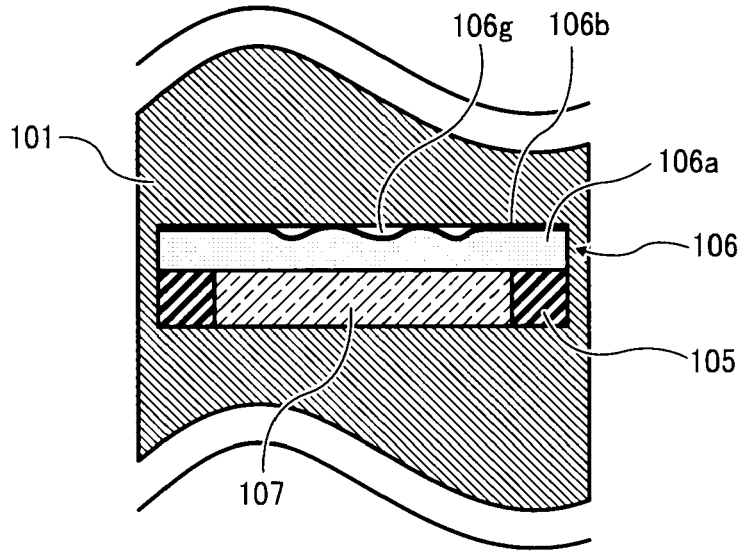
FIG. 11 is a schematic view illustrating a state in which the seal is deformed when a cutout portion is not formed in a film member of the seal.

FIG. 10 is a sectional view illustrating the shutter 105 and the opening 109 cut along a line X-X in FIG. 2. The shutter 105 contacts the wall face of the opening 109 at the rear-end portion 105*c* as illustrated in FIG. 6 as well and serves to support the entire shutter 105 including the seal members. The seal member 107 covers the opening, which is formed to provide the shutter 105 with the leaf spring portions 105*a*, and provides preferable elasticity in the vertical direction to the shutter 105. The seal 106 also provides preferable elasticity in the vertical direction to the shutter 105 to more closely contact the upper and lower faces of the opening 109. Further, the seal 106 is deformable by being pressed horizontally, thereby filling gaps between the shutter 105 and the opening 109. The film member 106*b* covers the upper face of the seal 106 to maintain the slidability of the shutter 105 and protect the surface of the seal 106. The cutout portion 106*c* of the film member 106*b* serves to absorb the deformation of the film member 106*b* in the horizontal direction. If it were not for the cutout portion 106*c*, the film member 106*b* would be deformed in a waved form as illustrated in FIG. 11. Such waved deformation might generate gaps 106*g*, thereby resulting in toner scatter. By contrast, according to this exemplary embodiment, the cutout portion 106*c* serves to absorb such deformation, thereby preventing toner from being scattered from gaps. The cutout portion 106*c* may be formed at a middle portion of the seal 106 so as to have a width of 6 mm, for example.

Figure 12:
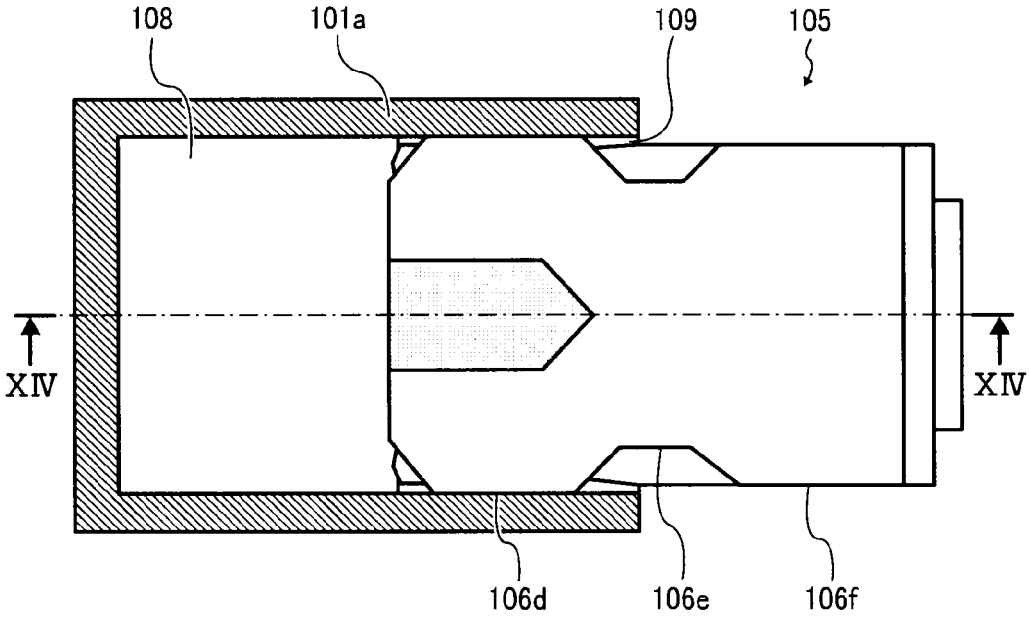
FIG. 12 is a top view illustrating an open state in which a toner supply port is opened with the shutter.

A front-end portion 106*d* of the seal 106 is wider than the opening 109 of the shutter 105. When the shutter 105 is inserted into the opening 109, the front-end portion 106*d* is shortened in the width direction or deformed inwardly so as to fill in gaps in the width direction as illustrated in FIG. 12. If the width of the front-end portion 106*d* of the seal 106 were too small, gaps might occur between the front-end portion 106*d* of the seal 106 and the wall face of the opening 109, thereby resulting in toner scattered from the gap. By contrast, if the width of the front-end portion of the seal 106 were too large, the front-end portion 106*d* of the seal 106 might become entangled with the sliding face of the shutter 105, thereby degrading the slidability of the shutter 105 or causing foreign material to get into the developing device 200. Hence, according to this exemplary embodiment, while the width of the front-end portion of the shutter 105 is set to, for example, approximately 15.4 mm, the width of the front-end portion of the seal 106 is set to a slightly larger size, for example, approximately 15.7 mm, so as to ensure a good balance between sealability and slidability.

The width of a middle portion 106*e* following the front-end portion 106*d* is narrower than the width of the shutter 105. Further, the width of a rear-end portion 106*f* of the seal 106 is substantially equal to or slightly narrower than the width of the shutter 105. Changing the width of the seal 106 as described above can provide a good balance between the sealability of the seal 106 against the opening 109 and the slidability of the shutter 105.

The above-described configuration can reduce the load for opening and closing the shutter 105 to, for example, a range of between approximately 0.3 kgf to approximately 0.5 kgf.

Next, a description is given of the shape of the front-end portion 106*d* of the seal 106.

FIG. 12 is a sectional view illustrating an open state in which the toner supply port 108 is opened with the shutter 105, which is cut along a line XII-XII in FIG. 2. In this state, the shutter 105 acts to open and close the opening 109. Except for cases in which the toner supply device 100 is detached from the image forming apparatus for maintenance and so on, the shutter 105 is in the open state. When the toner supply device 100 is operative, toner with increased fluidity flows into the toner supply port 108. Therefore, when the toner supply port 108 is opened, the shutter 105 needs to provide a relatively high sealability against the opening 109. Hence, according to this exemplary embodiment, by setting the width of the front-end portion 106*d* of the seal 106 wider than the width of the opening 109, the front-end portion 106*d* of the seal 106 can closely contact the inner wall of the opening 109. Accordingly, gaps between the front-end portion 106*d* of the seal 106 and the inner wall of the opening 109 can be securely filled, thereby preventing toner leak.

Figure 13:
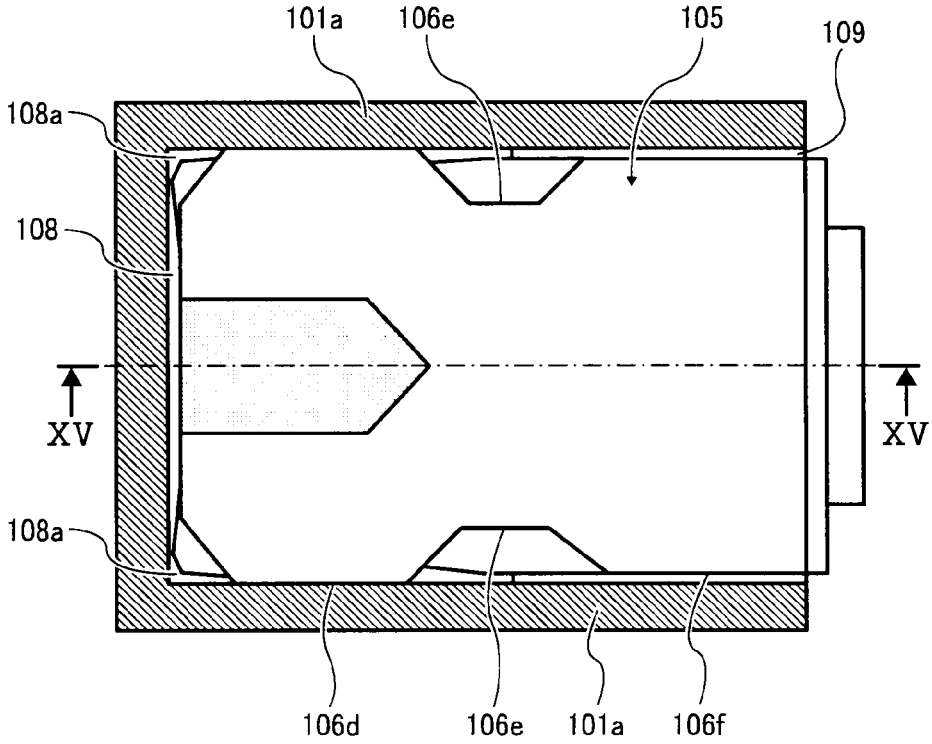
FIG. 13 is a top view illustrating a closed state in which the toner supply port is closed with the shutter.

Next, a description is given of the shape of the middle portion 106*e* of the seal 106. The middle portion 106*e* serves to block the toner flowing down the inside walls of the case 101 when the toner supply port 108 (the toner flow path t1) is closed with the shutter 105. The shutter 105 closes the toner supply port 108 when the toner supply device 100 is detached from the image forming apparatus. In such state, since the image forming apparatus is not operating and the toner is not moving, the toner supply port 108 need not provide such high sealability. Hence, as illustrated in FIG. 13, the width of the middle portion 106*e* of the seal 106 is set narrower than the width of the shutter 105. As described above, such configuration can reduce the area of a friction face between the wall face 101*a* and the shutter 105, thereby privileging slidability over sealability. It is to be noted that although the gaps 108*a* between the wall face 101*a* and the shutter 105 appear somewhat wide in FIG. 13, actually the gaps are set to a relatively small width of, for example, approximately 0.2 mm.

Next, a description is given of the rear-end portion 106*f* of the seal 106.

When the toner supply port 108 (the toner flow path t1) is closed with the shutter 105 as illustrated in FIG. 13, the rear-end portion 106*f* serves to close the opening 109. However, the shutter 105 takes this position when the toner supply device 100 is detached from the image forming apparatus, which is not so frequent. Further, in such state, because the toner supply device 100 is stopped, the fluidity of toner is not so high. Hence, according to this exemplary embodiment, the width of the rear-end portion 106*f* of the seal 106 is set substantially equal to or smaller than the width of the opening 109 or the shutter 105. Such configuration can provide sufficient sealing of the opening 109 and slidability of the shutter 105 so as not to cause failures in actual use.

As described above, the seal 106 is configured to have different widths in consideration of sealability suitable for each of the open and closed states of the toner supply port 108 (the toner flow path t1) with the shutter 105, thereby allowing the shutter 105 to achieve excellent balance between sealability and slidability.

Figure 14:
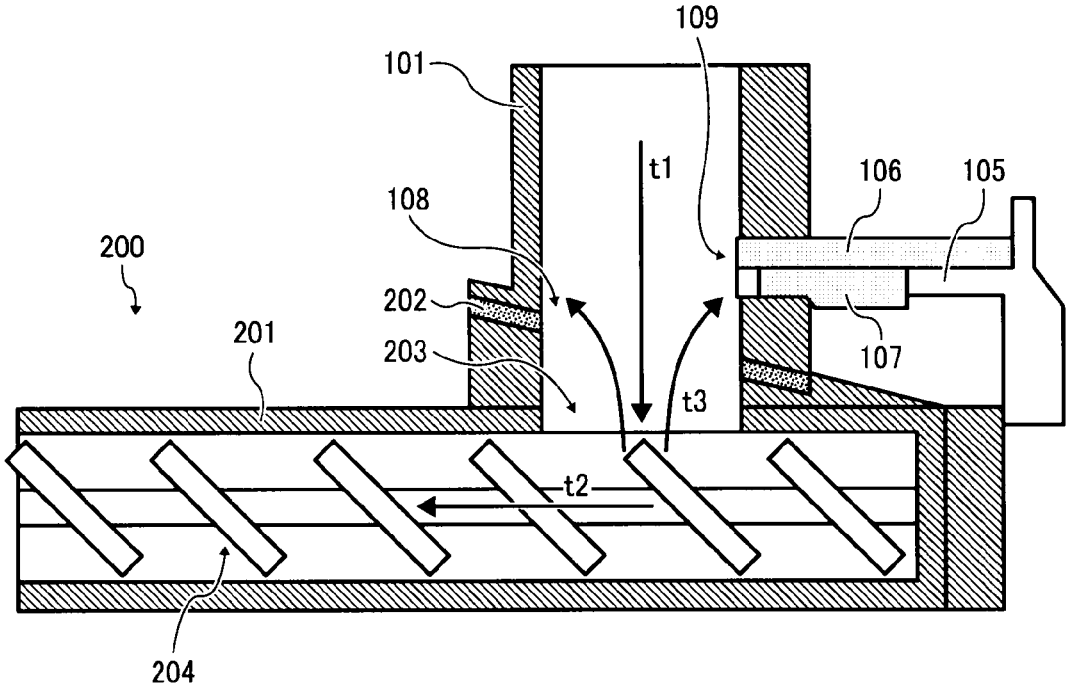
FIG. 14 is a side view illustrating the open state in which the toner supply port is opened with the shutter.

FIG. 14 is a sectional view illustrating a section XIV-XIV of FIG. 12. As illustrated in FIG. 14, the seal member 107 has a thickness capable of passing through the shutter 105 and, at the same time, protruding from the bottom face of the shutter 105 by approximately 0.6 mm, for example. The seal member 107 serves to close the opening 109 when the toner supply port 108 is opened with the shutter 105 as illustrated in FIG. 14. In such open state, the seal member 107 is positioned in the opening 109, and the shutter 105 is more closely contacted against the inner wall of the opening 109 in the vertical direction because of the portion protruding in a downward direction of the seal member 107 by approximately 0.6 mm. When the shutter 105 is in such open state, the image forming apparatus is operative and toner with increased fluidity flows into the side of the developing device 200 through the toner flow path t1, resulting in the need for relatively high sealability of the shutter 105. Hence, the above-described configuration allows the shutter 105 to more closely contact the inner wall of the opening 109, thereby achieving such high sealability.

Figure 15:
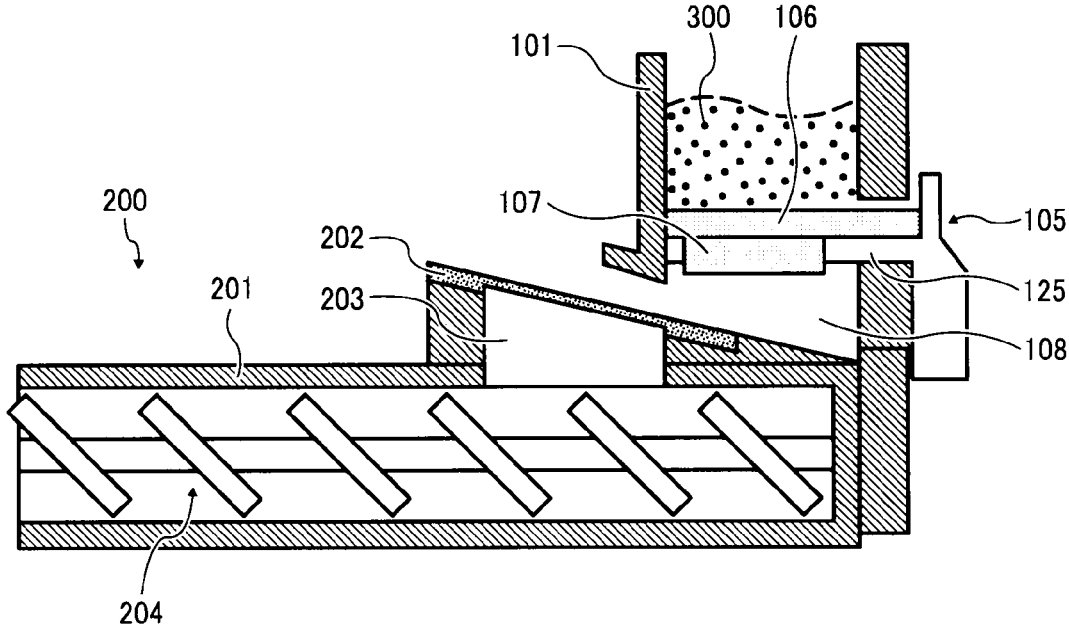
FIG. 15 is a side view illustrating the closed state in which the toner supply port is closed with the shutter.

By contrast, when the seal member 107 is detached from the opening 109 or the toner supply port 108 (the toner flow path t1) is closed with the shutter 105 as illustrated in FIG. 15 (illustrating a section cut along a line XV-XV in FIG. 13), the shutter 105 is slightly loosely inserted in the opening 109. When the toner supply port 108 is closed with the shutter 105, the toner supply device 100 is not operative and an intensive flow of toner is not generated. Hence, in such closed state, the slidability of the shutter 105 is prioritized over the sealability of the shutter 105 against the opening 109.

By using the seal member 107 as described above, the thickness of the seal member 107 can be varied based on which should be prioritized, sealability or slidability, so that the shutter 105 is allowed to strike a good balance between sealability and slidability.

Figure 16:
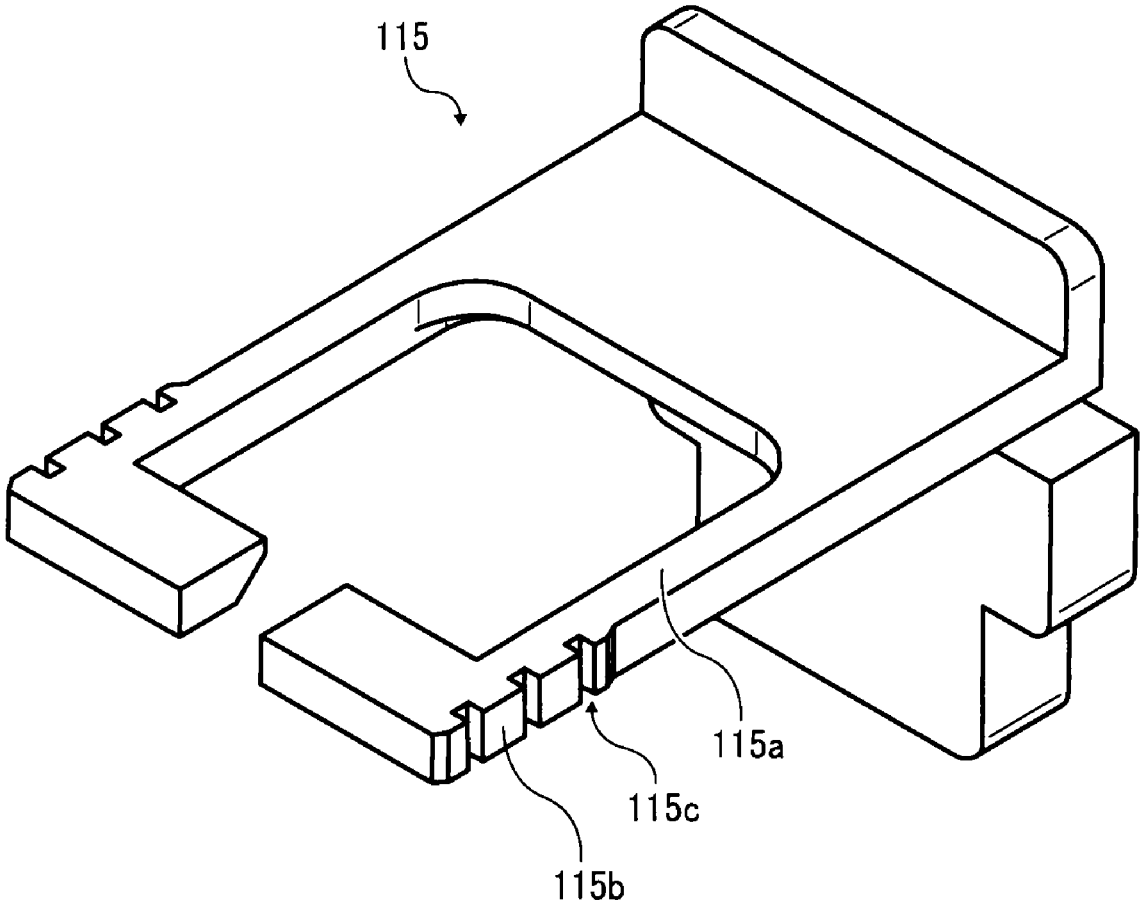
FIG. 16 is a schematic view illustrating a configuration of a shutter with grooves according to an exemplary embodiment.

FIG. 16 illustrates a shutter member 115 in which vertical grooves 115*c* are formed in convex portions 115*b* corresponding to the convex portions 105*b* of the shutter 105 of FIG. 4. The grooves 115*c* let out fine particles, including toner particles, sandwiched between the shutter 115 and the inner wall face of the case 101.

Figure 17:
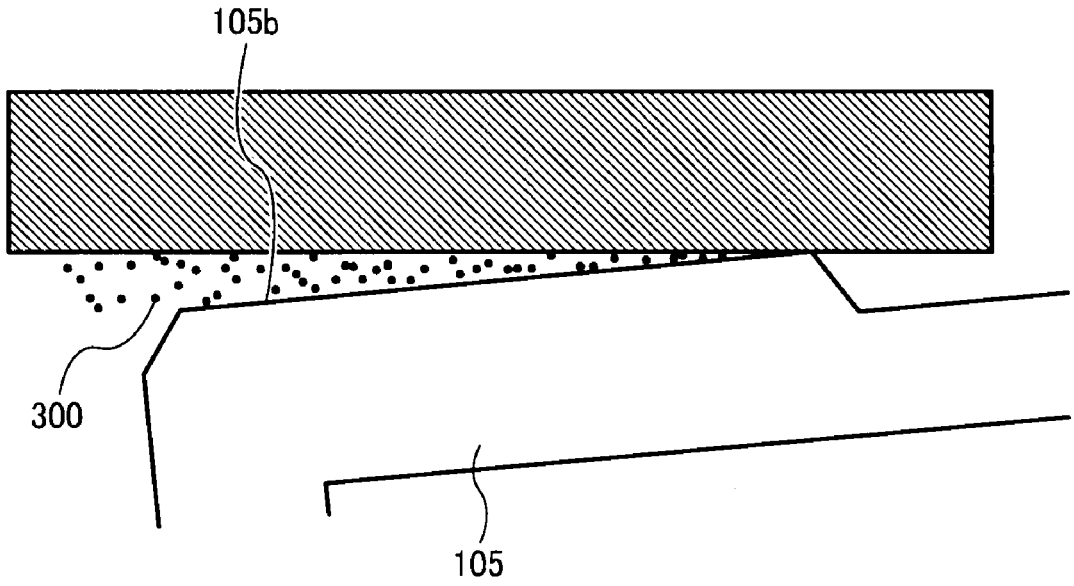
FIG. 17 is an enlarged view illustrating a shutter without grooves and an inner wall of the opening.

FIG. 17 is an enlarged view illustrating the wall face sliding against the shutter 105 not having such grooves. Since the shutter 105 is deformed inside the opening, the convex portions 105*b* of the shutter 105 are slightly inclined relative to the wall face. Accordingly, when the shutter 105 is closed or moved to the left side in FIG. 17, fine particles 300 may clog an inclined gap, resulting in operational failure of the shutter 105.

Figure 18:
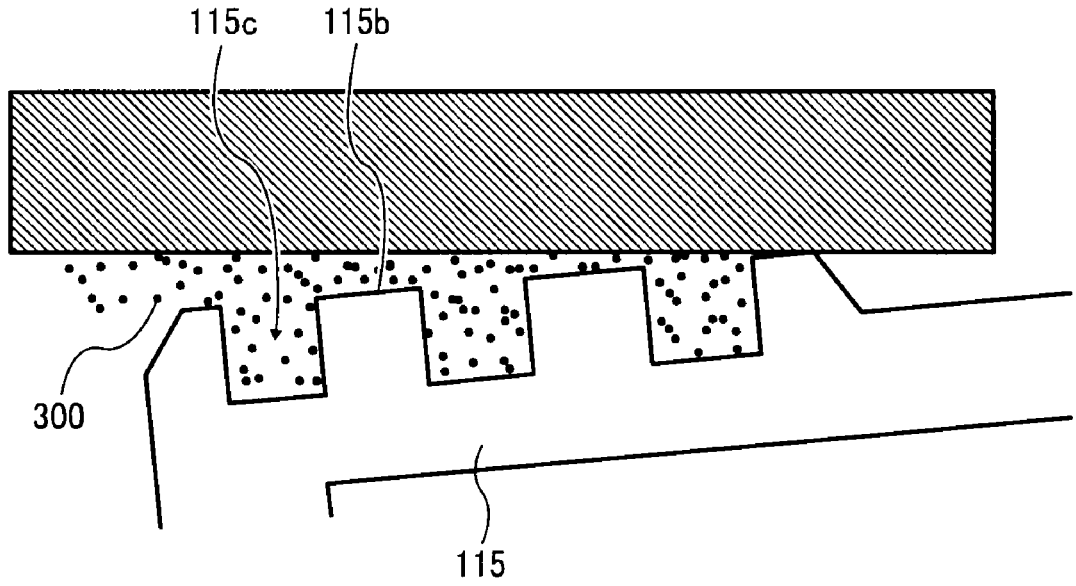
FIG. 18 is an enlarged view illustrating a shutter with grooves and the inner wall of the opening.
Figure 19:
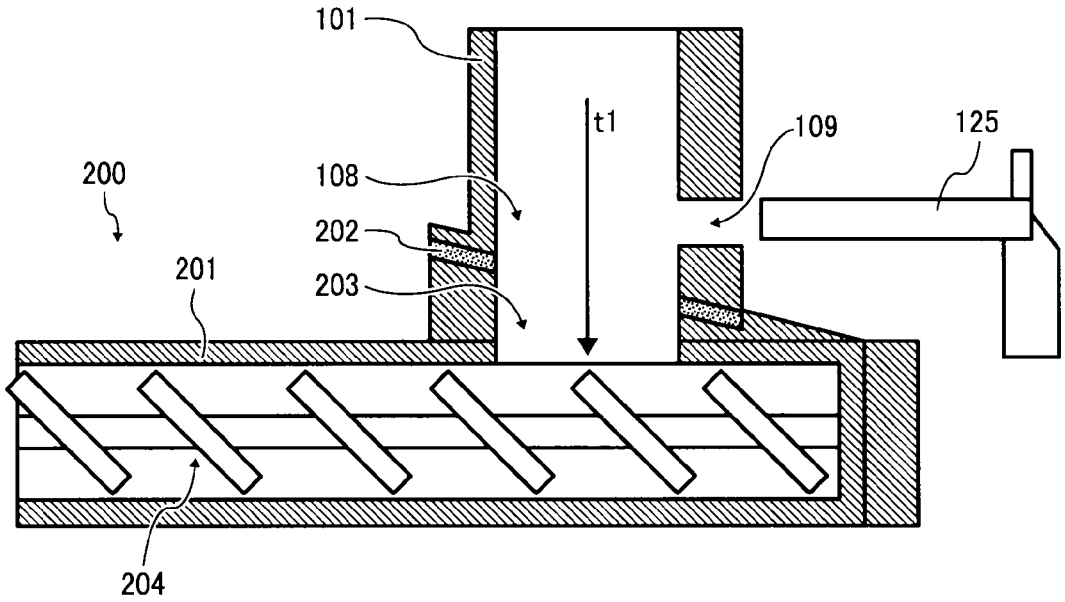
FIG. 19 RELATED ART
FIG. 19 is a schematic view illustrating an opening into which a shutter is inserted in a conventional toner supply device.
Figure 20:
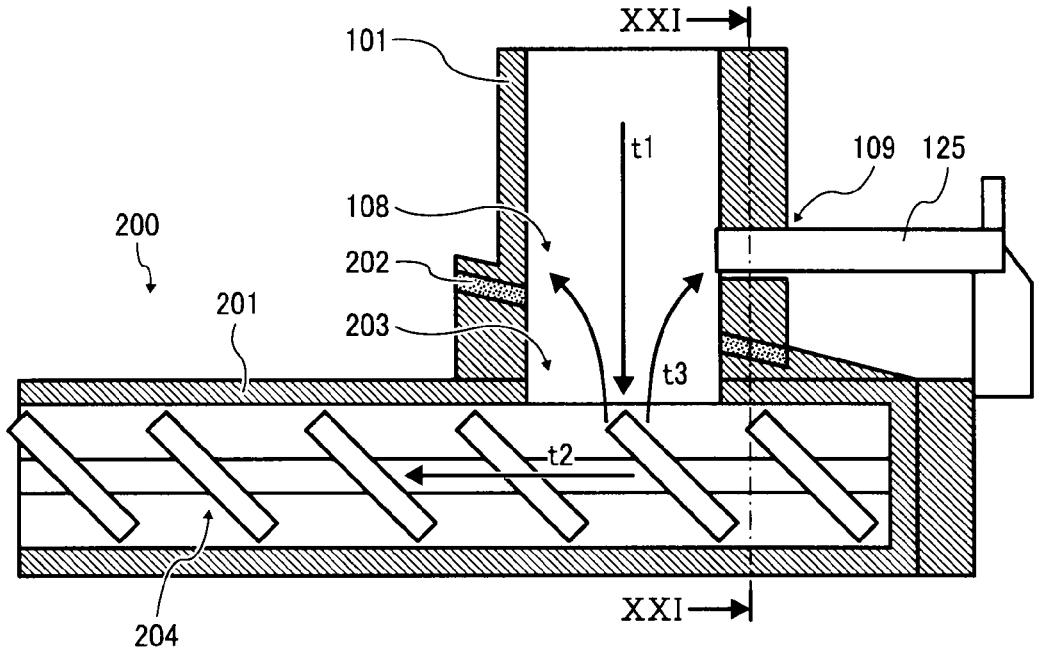
FIG. 20 RELATED ART
FIG. 20 is a schematic view illustrating operations of the shutter in the conventional toner supply device of FIG. 20.
Figure 21:
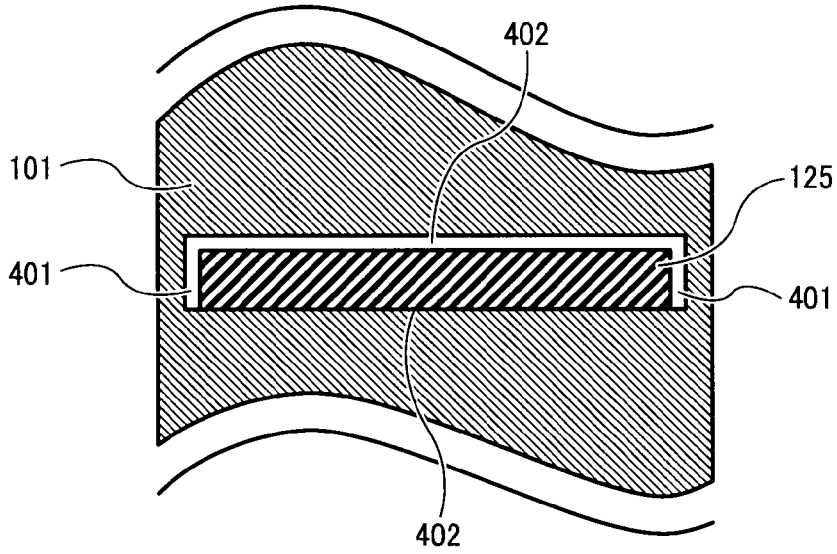
FIG. 21 RELATED ART
FIG. 21 is a schematic view illustrating a state in which there are gaps between an opening and a shutter.
Figure 22:
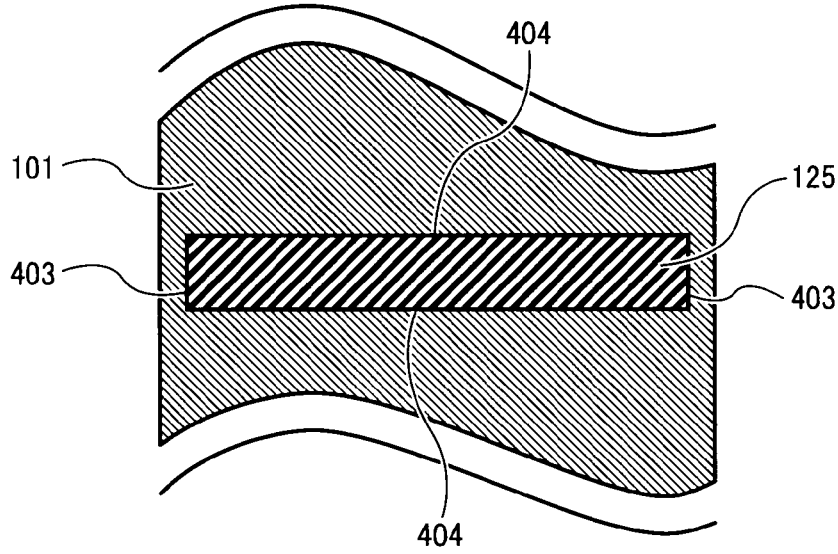
FIG. 22 RELATED ART
FIG. 22 is a schematic view illustrating a state in which there is no gap between the opening and the shutter.

By contrast, as illustrated in FIG. 18, the shutter 115 having the grooves 115*c* can let out fine particles into the grooves 115*c*, thereby preventing the clogging of the particles.

As described above, according to the above-described exemplary embodiment, the toner supply device 100 includes the case 101 serving as both the toner container that stores toner and the transport path member that forms a transport path for transporting the toner stored in the case 101, the toner flow path t1 serving as the transport path, the opening 109 serving as the opening formed in one side face of the case 101, the shutter 105 serving as the shutter member movable between the closed position to close the toner flow path t1 by being inserted to the opening 109 and the open position to open the toner flow path t1, and the seal 106 serving as the seal member to fill gaps appearing in the toner transport direction of the toner flow path t1 between the inner wall of the opening 109 and the shutter 105. In the toner supply device 100, the shutter 105 is elastically deformable in a deformation direction perpendicular to both the toner transport direction and the movable direction of the shutter 105 when the shutter 105 is inserted in the opening 109. A width of the shutter 105 is larger than a width of the opening 109 in the deformation direction when the shutter 105 is not inserted in the opening 109. Such configuration allows the shutter 105 to be inserted in the opening 109 while being elastically deformed in the deformation direction. Thus, when the shutter 105 is inserted in the opening 109, the width of the shutter 105 can be equal to the width of the opening 109 in the deformation direction. In this regard, if the width of the shutter 105 in the deformation direction with the shutter 105 being inserted in the opening 109 were too large compared to the width of opening 109, the slidability of the shutter 105 might be degraded. By contrast, if the width of the shutter 105 in the deformation direction with the shutter 105 being inserted in the opening 109 were too small compared to the width of opening 109, gaps might appear between the shutter 105 and the inner wall of the opening 109. Hence, according to the above-described configuration, the toner supply device 100 can prevent such degradation of the slidability and appearance of gaps.

Further, a width of the seal 106 in a deformation direction perpendicular to both the toner transport direction and the moving direction of the shutter 105 when the shutter 105 is not inserted in the opening 109 is greater than a width of the opening 109 in the deformation direction at the front-end portion 106*d*, which closes the opening 109 when the shutter 105 is at the above-described open position. The width of the seal 106 is substantially equal to the width of the opening 109 at the rear-end portion 106*f*, which closes the opening 109 when the shutter 105 is at the closed position. Such configuration allows the seal 106 and the inner wall of the opening 109 to closely contact each other at the front-end portion 106*d*. Thus, the sealability of the shutter 105 against the opening 109 is prioritized and the width of the rear-end portion 106*f* of the shutter 105 is substantially equal to the width of the opening 109, thereby providing a good balance between the sealing of the opening 109 and the slidability of the shutter 105.

Further, the seal 106 can prevent gaps from appearing between the shutter 105 and the inner wall of the opening 109 in the toner transport direction t1. Accordingly, the toner supply device 100 can reliably open and close the shutter 105 while preventing toner from being scattered from the opening 109.

As described above, the side portions of the shutter 105 in the deformation direction are formed by leaf springs, thereby providing the desired elasticity in the deformation direction (or the width direction of the shutter 105) and the desired stiffness in the toner transport direction (or the thickness direction of the shutter 105).

As described above, the convex portions 105*b* are formed in the side faces of the shutter 105 in the deformation direction (or the width direction of the shutter 105), thereby reducing the contact area between the side faces of the shutter 105 and the inner wall of the opening 109. Such configuration can reduce the frictional force between the side faces of the shutter 105 and the inner wall of the opening 109 generated when the shutter 105 moves between the closed position and the open position, thereby enhancing the slidability of the shutter 105.

As described above, the seal 106 is elastically deformable and is provided to at least one face of upstream-side and downstream-side faces of the shutter 105 in the toner transport direction. Such configuration can provide relatively high operability compared to a configuration in which the seal 106 is provided on the opening 109 or any other portion in the body of the image forming apparatus.

As described above, the middle portion of the seal 106 is narrower than the shutter 105 in the deformation direction. Accordingly, the seal 106 is not in contact with the inner wall of the opening 109, thereby providing excellent slidability of the shutter 105.

As described above, the toner supply device 100 includes the film member 106*b* covering the seal 106. The cutout portion 106*c* is formed in the middle portion of the film member 106*b* in the deformation direction, thereby preventing the film member 106*b* from being deformed in a wavy form due to deformation of the shutter 105 in the deformation direction (the width direction of the shutter 105). Accordingly, the toner supply device 100 can prevent gaps from appearing between the seal 106 covered with the film member 106*b* and the inner wall of the opening 109 due to wavy deformation of the film member 106*b*.

As described above, the seal member 107 is provided on a face (hereinafter an "opposite face") of the shutter 105 opposite to the face on which the seal 106 is provided. The seal member 107 does not entirely cover the opposite face. In other words, the shutter 105 includes a portion in which sealability is prioritized over slidability, i.e., the seal member 107 is closely contacted with the inner wall of the opening 109 so as to reliably prevent toner leak and another portion in which slidability is prioritized, i.e., the seal member 107 is not contacted against the inner wall of the opening 109. Such configuration can provide excellent balance between the sealing of the opening 109 and the slidability of the shutter 105.

As described above, the vertical grooves 115*c* are provided in the lateral side faces of the shutter 105 in the deformation direction (or the width direction of the shutter 105), thereby allowing toner incorporated in a space between the side faces of the shutter 105 and the inner wall of the opening 109 to escape via the grooves 115*c*. Such configuration can prevent toner from clogging the space between the side faces and the inner wall, thereby suppressing degradation of the slidability of the shutter 105.

As described above, the image forming apparatus 1000, which is described taking as a copier an example, includes the photoconductors 1 serving as the latent image carriers to carry a latent image, and the developing device 200 serving as the developing unit to develop the latent image on the photoconductor 1. Further, the image forming apparatus 1000 includes the toner supply device 100 serving as the toner supply unit, thereby allowing the shutter 105 to be reliably opened and closed when the toner supply device 100 is mounted in and detached from the image forming apparatus 1000. Such configuration can prevent toner from being scattered from the opening 109, thereby preventing toner from contaminating the image forming apparatus and/or its surrounding area.

It is to be noted that although in the above-described exemplary embodiment the seal 106 for filling gaps between the upper face of the shutter 105 and the opening 109 is provided to the upper face of the shutter 105, alternatively the seal 106 may be provided to the inner face of the opening 109 or any other suitable portion in accordance with the configuration of the shutter 105.

Exemplary embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. A toner supply device, comprising:

a toner container configured to store toner;

a transport-path forming member configured to form a transport path to transport the toner stored in the toner container to the outside of the toner container;

an opening provided at a side wall of the transport-path forming member;

a shutter member movable between a closed position to close the transport path by being inserted in the opening and an open position to open the transport path; and a first seal member configured to fill a gap between an inner wall of the opening and the shutter member in a toner transport direction in which the toner is transported through the transport path, wherein, when the shutter member is inserted in the opening, the shutter member is elastically deformable in a deformation direction perpendicular to both the toner transport direction and a moving direction of the shutter member, the shutter member being wider than the opening in the deformation direction when the shutter member is not inserted in the opening.

2. The toner supply device according to claim 1, wherein a side portion of the shutter member in the deformation direction includes a leaf spring.

3. The toner supply device according to claim 1, wherein a convex portion is provided to a side face of the shutter member in the deformation direction.

4. The toner supply device according to claim 3, wherein a groove is provided in the convex portion provided to a side face of the shutter member in the deformation direction.

5. The toner supply device according to claim 1, wherein the first seal member is elastically deformable and is provided to at least one face of upstream-side and downstream-side faces of the shutter member in the toner transport direction.

6. The toner supply device according to claim 5, further comprising a film member configured to cover the first seal member, wherein a cutout portion is provided at a middle portion of the film member in the deformation direction of the shutter member.

7. The toner supply device according to claim 1, wherein, when the shutter member is not inserted in the opening, the first seal member is wider than the opening in the deformation direction at a portion of the first seal member that closes the opening when the shutter member is at the open position, and is substantially equal to the opening in the deformation direction at another portion of the first seal member that closes the opening when the shutter member is at the closed position.

8. The toner supply device according to claim 7, wherein a middle portion of the first seal member in the moving direction of the shutter member is narrower than the shutter member in the deformation direction.

9. The toner supply device according to claim 7, further comprising a second seal member provided on a second face of the shutter member opposite to a first face on which the first seal member is provided, wherein the second seal member partially covers the second face of the shutter member.

10. An image forming apparatus, comprising:

a latent image carrier configured to carry a latent image;

a developing unit configured to develop the latent image carried on the latent image carrier with toner into a toner image; and a toner supply device configured to supply the toner to the developing unit, the toner supply device including:

a toner container configured to store the toner;

a transport-path forming member configured to form a transport path to transport the toner stored in the toner container to the developing unit;

an opening provided at a side wall of the transport-path forming member;

a shutter member movable between a first position to close the transport path by being inserted in the opening and a second position to open the transport path; and a first seal member configured to fill a gap between an inner wall of the opening and the shutter member in a toner transport direction in which the toner is transported through the transport path, wherein, when the shutter member is inserted in the opening, the shutter member is elastically deformable in a deformation direction perpendicular to both the toner transport direction and a moving direction of the shutter member, the shutter member being wider than the opening in the deformation direction when the shutter member is not inserted in the opening.

11. The image forming apparatus according to claim 10, wherein a side portion of the shutter member in the deformation direction includes a leaf spring.

12. The image forming apparatus according to claim 10, wherein a convex portion is provided to a side face of the shutter member in the deformation direction.

13. The image forming apparatus according to claim 12, wherein a groove is provided in the convex portion provided to a side face of the shutter member in the deformation direction.

14. The image forming apparatus according to claim 10, wherein the first seal member is elastically deformable and is provided to at least one face of upstream-side and downstream-side faces of the shutter member in the toner transport direction.

15. The image forming apparatus according to claim 14, wherein the toner supply device further includes a film member configured to cover the first seal member and a cutout portion is provided at a middle portion of the film member in the deformation direction.

16. The image forming apparatus according to claim 10, wherein, when the shutter member is not inserted in the opening, the first seal member is wider than the opening in the deformation direction at a portion of the first seal member that closes the opening when the shutter member is at the open position, and is substantially equal to the opening in the deformation direction at another portion of the first seal member that closes the opening when the shutter member is at the closed position.

17. The image forming apparatus according to claim 16, wherein a middle portion of the first seal member in the moving direction of the shutter member is narrower than the shutter member in the deformation direction.

18. The image forming apparatus according to claim 16, further comprising a second seal member provided on a second face of the shutter member opposite to a first face on which the first seal member is provided, wherein the second seal member partially covers the second face of the shutter member.

19. A toner supply device, comprising:

a toner container configured to store toner;

a transport-path forming member configured to form a transport path to transport the toner stored in the toner container to the outside of the toner container;

an opening provided at a side wall of the transport-path forming member;

a shutter member movable between a closed position to close the transport path by being inserted in the opening and an open position to open the transport path; and wherein, when the shutter member is inserted in the opening, the shutter member is elastically deformable in a deformation direction perpendicular to both the toner transport direction and a moving direction of the shutter member, the shutter member being wider than the opening in the deformation direction when the shutter member is not inserted in the opening.

* * * * *